US011843161B2

(12) United States Patent
Wu

(10) Patent No.: US 11,843,161 B2
(45) Date of Patent: Dec. 12, 2023

(54) RADIATING ELEMENT AND BASE STATION ANTENNA

(71) Applicant: CommScope Technologies LLC, Hickory, NC (US)

(72) Inventor: Bo Wu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/490,131

(22) Filed: Sep. 30, 2021

(65) Prior Publication Data

US 2022/0123478 A1 Apr. 21, 2022

(30) Foreign Application Priority Data

Oct. 15, 2020 (CN) ..... 202011100811.0

(51) Int. Cl.

| | |
|---|---|
| ***H01Q 1/24*** | (2006.01) |
| ***H01Q 5/48*** | (2015.01) |
| ***H01Q 21/06*** | (2006.01) |
| ***H01Q 1/38*** | (2006.01) |
| ***H01Q 1/52*** | (2006.01) |
| ***H01Q 9/28*** | (2006.01) |
| ***H01Q 21/26*** | (2006.01) |
| ***H01Q 5/321*** | (2015.01) |
| ***H01Q 25/00*** | (2006.01) |

(52) U.S. Cl.

CPC ..... *H01Q 1/246* (2013.01); *H01Q 1/38* (2013.01); *H01Q 1/521* (2013.01); *H01Q 5/321* (2015.01); *H01Q 5/48* (2015.01); *H01Q 9/285* (2013.01); *H01Q 21/062* (2013.01); *H01Q 21/26* (2013.01); *H01Q 25/001* (2013.01)

(58) Field of Classification Search

CPC ..... H01Q 1/246; H01Q 1/36; H01Q 1/38; H01Q 1/521; H01Q 5/321; H01Q 5/35; H01Q 5/48; H01Q 5/364; H01Q 9/285; H01Q 21/0075; H01Q 21/062; H01Q 21/26; H01Q 21/30; H01Q 25/001

See application file for complete search history.

(56) References Cited

U.S. PATENT DOCUMENTS

2018/0323513 A1 11/2018 Varnoosfaderani et al.

FOREIGN PATENT DOCUMENTS

| | | | |
|---|---|---|---|
| CN | 109103591 A | * | 12/2018 |
| CN | 109103591 A | | 12/2018 |
| EP | 3614491 A1 | | 2/2020 |
| WO | 2019009951 A1 | | 1/2019 |

OTHER PUBLICATIONS

European Search Report Corresponding to European Application No. 21201822.0 (15 pages) (dated Mar. 21, 2022).

* cited by examiner

*Primary Examiner* — Robert Karacsony
(74) *Attorney, Agent, or Firm* — Myers Bigel, P.A.

(57) ABSTRACT

A radiating element may have a dipole arm that may include a first conductive circuit loop and a second conductive circuit loop. The first conductive circuit loop may include at least one narrow conductive segment and at least one wide conductive segment, and the narrow conductive segment may present high impedance characteristics in at least one frequency band outside the operating frequency band of the radiating element to suppress at least partially the current in the at least one frequency band. A base station antenna may include a feed board and the radiating element mounted on the feed board.

20 Claims, 6 Drawing Sheets

RADIATING ELEMENT AND BASE STATION ANTENNA

CROSS-REFERENCE TO RELATED APPLICATION

The present application claims the benefit of priority to Chinese Patent Application No. 202011100811.0, filed on Oct. 15, 2020, and the entire contents of the above-identified application are incorporated by reference as if set forth herein.

TECHNICAL FIELD

The present disclosure generally relates to radio communications and, more particularly, to a radiating element and a base station antenna for a cellular communications system.

BACKGROUND

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors." In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower structure, with the radiation patterns (also referred to herein as "antenna beams") that are generated by the base station antennas directed outwardly. Base station antennas are often implemented as linear or planar phased arrays of radiating elements.

In order to accommodate the ever-increasing volumes of cellular communications, cellular operators have added cellular services in a variety of new frequency bands. While in some cases it is possible to use linear arrays of so-called "wide-band" or "ultra wide-band" radiating elements to provide service in multiple frequency bands, in other cases it is necessary to use different linear arrays or planar arrays of radiating elements to support service in the different frequency bands.

As the number of frequency bands has proliferated, increased sectorization has become more common (e.g., dividing a cell into six, nine or even twelve sectors), and the number of base station antennas deployed at a typical base station has increased significantly. However, due to local zoning ordinances and/or weight and wind loading constraints for the antenna towers, etc. there is often a limit as to the number of base station antennas that can be deployed at a given base station. In order to increase capacity without further increasing the number of base station antennas, so-called multi-band base station antennas have been introduced in which multiple linear arrays of radiating elements are included in a single antenna. One very common multi-band base station antenna includes one linear array of "low-band" radiating elements that are used to provide service in some or all of the 617-960 MHz frequency band, and two or four linear arrays of "mid-band" radiating elements that are used to provide service in some or all of the 1427-2690 MHz frequency band. These linear arrays of radiating elements are typically mounted in side-by-side fashion.

However, as the linear arrays of radiating elements are aligned closer together, the degree of signal coupling between the linear arrays can increase significantly. For example, the coupling interference between the low-band radiating elements or between the high-band radiating elements may increase. In addition, the low-band radiating element may produce large scattering effects on nearby mid-band radiating elements. This coupling interference can negatively affect the corresponding radiation pattern characteristics of the mid-band linear arrays. However, any change in the dimension of the low-band radiating elements will also often affect the radio frequency performance of the low-band radiating elements, for example, a change in their own working frequency band, an increase in HPBW, etc.

SUMMARY

Therefore, an object of the present disclosure is to provide a radiating element and a related base station antenna capable of overcoming at least one drawback in the prior art.

According to a first aspect of the present disclosure, a radiating element is provided, and a dipole arm of the radiating element may include a first conductive circuit loop and a second conductive circuit loop which is at least partially separated from the first conductive circuit loop. The first conductive circuit loop may include at least one narrow conductive segment and at least one wide conductive segment. The narrow conductive segment may exhibit high impedance characteristics in at least one frequency band outside an operating frequency band of the radiating element so as to at least partially suppress currents in the at least one frequency band.

According to a second aspect of the present disclosure, a radiating element is provided, and a dipole arm of the radiating element may include a first conductive circuit loop and a second conductive circuit loop. The first conductive circuit loop may be provided on a first main surface of a dielectric plate, a first part of the second conductive circuit loop may be provided on the first main surface of the dielectric plate, and a second part of the second conductive circuit loop may be provided on a second main surface of the dielectric plate.

According to a third aspect of the present disclosure, a base station antenna is provided, and the base station antenna includes a feed board and the radiating element according to the present disclosure mounted on the feed board.

DETAILED DESCRIPTION

Figure 1:
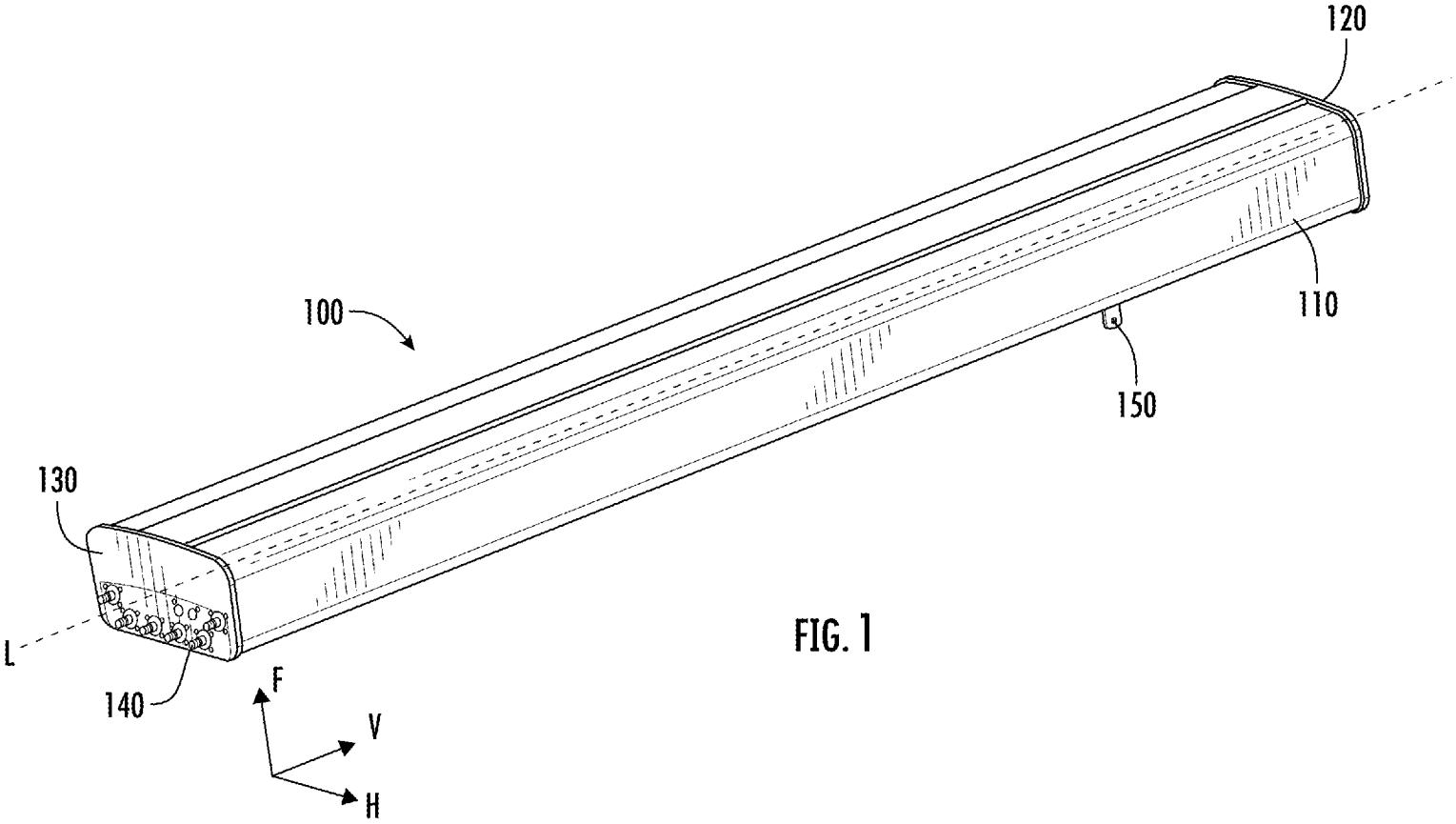
FIG. 1 is a schematic perspective view of a base station antenna according to some embodiments of the present disclosure.

The disclosure will be described below with reference to the appended drawings, and the appended drawings illustrate several embodiments of the disclosure. However, it should be understood that the disclosure may be presented in many different ways and is not limited to the embodiments described below; in fact, the embodiments described below are intended to make the disclosure of the disclosure more complete and to fully explain the protection scope of the disclosure to those skilled in the art. It should also be understood that the embodiments disclosed in the disclosure may be combined in various ways so as to provide more additional embodiments.

It should be understood that in all the appended drawings, the same reference numerals and signs denote the same elements. In the appended drawings, the dimensions of certain features can be distorted for clarity.

It should be understood that the terms in the specification are only used to describe specific embodiments and are not intended to limit the disclosure. Unless otherwise defined, all terms (including technical terms and scientific terms) used in the specification have the meanings commonly understood by those skilled in the art. For brevity and/or clarity, well-known functions or structures may not be described in detail.

The singular forms "a," "an," "the" and "this" used in the specification all include plural forms unless clearly indicated. The words "include," "contain" and "have" used in the specification indicate the presence of the claimed features, but do not exclude the presence of one or more other features. The word "and/or" used in the specification includes any or all combinations of one or more of the related listed items. The words "between X and Y" and "between approximate X and Y" used in the specification shall be interpreted as including X and Y. As used herein, the wording "between about X and Y" means "between about X and about Y," and as used herein, the wording "from about X to Y" means "from about X to about Y."

In the specification, when an element is referred to as being "on," "attached" to, "connected" to, "coupled" with, "contacting," etc., another element, it can be directly on, attached to, connected to, coupled with or contacting another element or an intervening element may also be present. In contrast, if an element is described "directly" "on" another element, "directly attached" to another element, "directly connected" to another element, "directly coupled" to another element or "directly contacting" another element, there will be no intermediate elements. In the specification, a feature that is arranged "adjacent" to another feature, may denote that a feature has a part that overlaps an adjacent feature or a part located above or below the adjacent feature.

In the specification, terms expressing spatial relations such as "upper," "lower," "left," "right," "front," "rear," "top," and "bottom" may describe the relation between one feature and another feature in the appended drawings. It should be understood that, in addition to the orientations shown in the appended drawings, the terms expressing spatial relations further include different orientations of a device in use or operation. For example, when a device in the appended drawings rotates reversely, the features originally described as being "below" other features now can be described as being "above" the other features. The device may also be oriented in other directions (rotated by 90 degrees or in other orientations), and in this case, a relative spatial relation will be explained accordingly.

Embodiments of the present disclosure will now be described in more detail with reference to the accompanying drawings.

Figure 2:
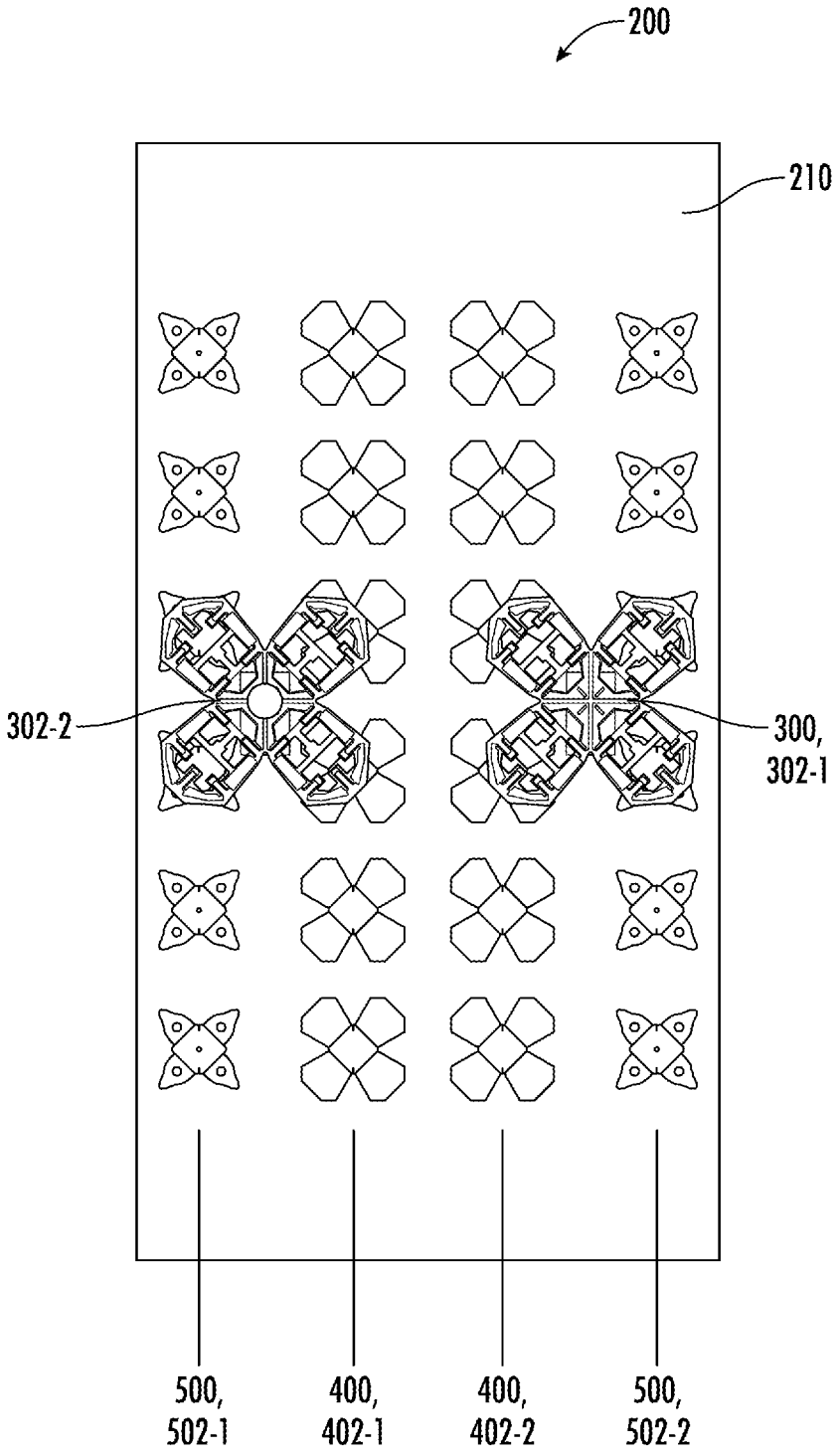
FIG. 2 is a schematic front view of an antenna assembly in the base station antenna of FIG. 1.

FIG. 1 is a schematic perspective view of a base station antenna 100 according to some embodiments of the present disclosure, and FIG. 2 is a schematic front view of an antenna assembly 200 in the base station antenna 100 of FIG. 1.

As shown in FIG. 1, the base station antenna 100 is an elongated structure that extends along a longitudinal axis L. The base station antenna 100 may have a tubular shape with a generally rectangular cross-section. The base station antenna 100 includes a radome 110 and a top end cap 120. One or more mounting brackets 150 are provided on the rear side of the radome 110 which may be used to mount the base station antenna 100 onto an antenna mount 150 (not shown) on, for example, an antenna tower. The base station antenna 100 also includes a bottom end cap 130 which includes a plurality of connectors 140 mounted therein. The base station antenna 100 is typically mounted in a vertical configuration (e.g., the longitudinal axis L may be generally perpendicular to a plane defined by the horizon when the base station antenna 100 is mounted for normal operation).

As shown in FIG. 2, the base station antenna 100 includes an antenna assembly 200 that may be slidably inserted into the radome 110. The antenna assembly 200 includes a reflector 210 and a plurality of arrays of radiating elements mounted on the reflector 210. The reflector 210 may be used as a ground plane structure for each radiating element, and each radiating element is mounted to extend forwardly (in a forward direction F) from the reflector 210. The arrays may be, for example, linear arrays of radiating elements or two-dimensional arrays of radiating elements. In some embodiments, the arrays may extend substantially along the entire length of the base station antenna 100. In other embodiments, the arrays may also extend only partially along the length dimension of the base station antenna 100. These arrays may extend from the lower end to the upper end of the base station antenna 100 in a vertical direction V, which may be the direction of a longitudinal axis L of the base station antenna 100 or may be parallel to the longitudinal axis L. The vertical direction V is perpendicular to a horizontal direction H and a forward direction F (see FIG. 1).

In the embodiment of FIG. 2, six linear arrays of radiating elements are exemplarily shown: two low-band arrays 302-1302-2, two mid-band arrays 402-1, 402-2, and two mid-band arrays 502-1, 502-2, where the two low-band arrays 302-1, 302-2 are schematically represented as each having a single low-band radiating element 300. The operating frequency band of the low-band radiating elements 300 may be, for example, 617 MHz to 960 MHz or one or more partial ranges thereof. The operating frequency band of the mid-band radiating elements 400 may be, for example, 1427 MHz to 2690 MHz or one or more partial ranges thereof. The operating frequency band of the mid-band radiating elements 500 may be, for example, 1690 MHz to 2690 MHz or one or more partial ranges thereof. In other embodiments, an array of high-band radiating elements may also be provided, and the operating frequency band thereof may be 3 GHz to 5.8 GHz or one or more partial ranges thereof.

Figure 3:
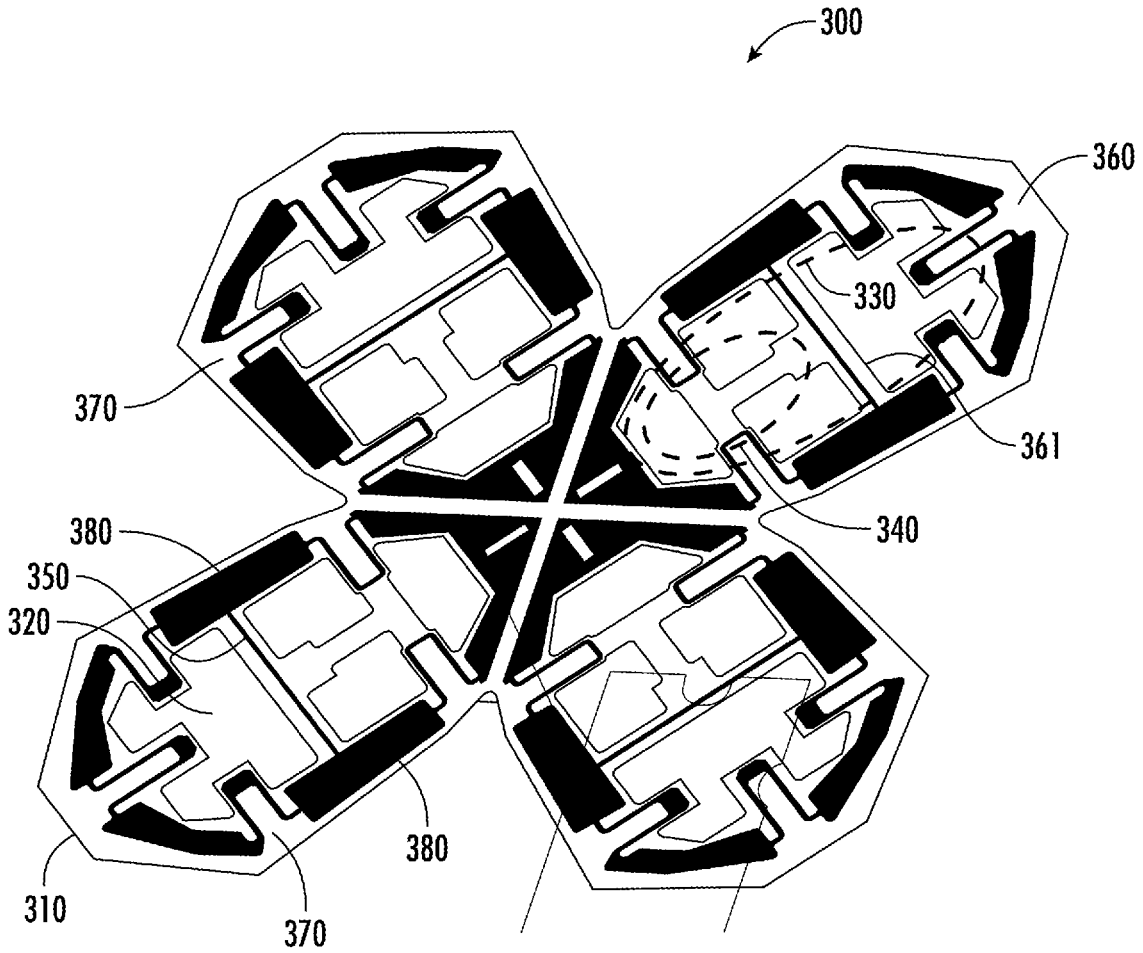
FIG. 3 is a schematic perspective view of a radiating element according to some embodiments of the present disclosure.
Figure 4:
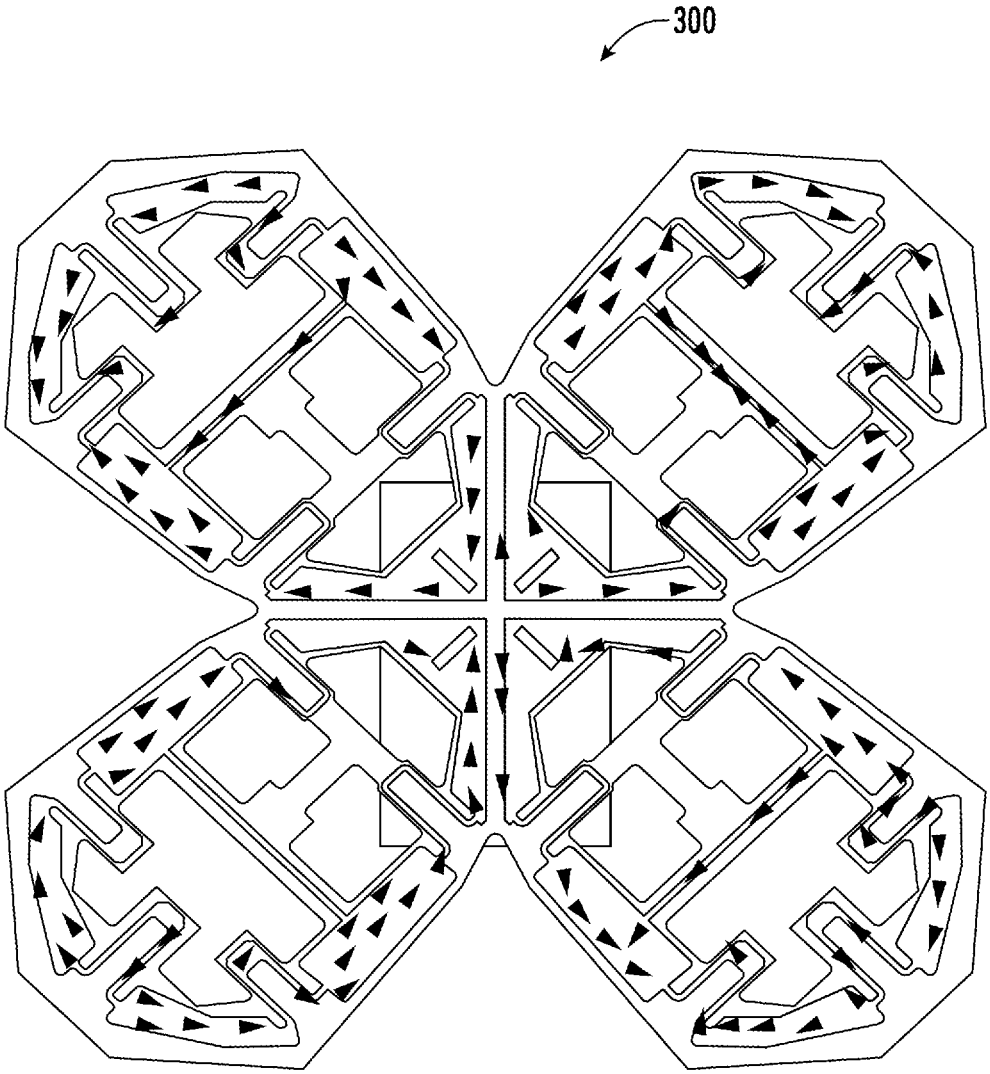
FIG. 4 is a schematic current distribution diagram of the radiating element of FIG. 3.

Next, the radiating element 300 according to some embodiments of the present disclosure will be described in more detail with reference to FIGS. 3 and 4. In the embodiments of FIGS. 3 and 4, the radiating element 300 may be configured as a low-band radiating element of FIG. 2 to transmit and receive RF signals in a frequency band such as 617-960 MHz frequency range or a portion thereof. In other embodiments, the radiating elements may also be configured as other frequency band radiating elements. In other embodiments, the radiating element 300 may also be configured as a wideband radiating element.

FIG. 3 shows a schematic perspective view of the radiating element 300. In the embodiment of FIG. 3, the radiating element 300 includes a cross radiator that is formed of sheet metal. The cross radiator may be supported on a dielectric plate which is a supporting structure 360. The sheet metal radiators are advantageous in that: firstly, the sheet metal radiators are lower in cost; secondly, the sheet metal radiators may be formed to have any desired thickness, and hence may exhibit improved impedance matching and/or reduced signal transmission losses; thirdly, the sheet metal radiators may be readily provided with low levels of surface roughness, which may result in improved passive intermodulation ("PIM") distortion performance.

The cross radiator structure includes a first dipole radiator and a second dipole radiator. Each dipole radiator includes a pair of dipole arms 310. It should be understood that the specific configuration of the dipole arm 310 is not limited in the present disclosure. In other embodiments, the dipole arm 310 of the radiating element may be formed as a printed circuit board dipole arm that comprises a printed metal pattern on a dielectric plate.

Each dipole arm 310 of the radiating element 300 may include an annular arm or conductive circuit loop (hereinafter referred to as the first conductive circuit loop 330) constituted by at least one narrow conductive segment 370 and at least one wide conductive segment 380. Each first conductive circuit loop 330 may include two conductive paths, wherein a first conductive path forms half of the dipole arm 310, and a second conductive path forms the other half of the dipole arm 310. The narrow conductive segment 370 may be configured as a meandered arm segment to increase the path length thereof, thereby facilitating the compactness of the radiating element 300 and/or a desired filtering effect with respect to high-band radiation. The wide conductive segment 380 may have a first width and the narrow conductive segment 370 may have a second width. The first width of each wide conductive segment 380 and the second width of each narrow conductive segment 370 need not to be constant. Therefore, in some instances reference will be made to the average widths of the wide conductive segment 380 and the narrow conductive segment 370. The average width of each wide conductive segment 380 may be, for example, at least twice the average width of each narrow conductive segment 370. In other instances, the average width of each wide conductive segment 380 may be, for example, at least three times, four times, five times, six times, eight times, or ten times the average width of each narrow conductive segment 370.

The first conductive path and the second conductive path are spaced apart from each other at least over part of the segments, that is, there is a gap 320 between the first conductive path and the second conductive path. In some cases, the gap 320 between a first wide conductive segment 380 of the first conductive path and a second wide conductive segment 380 of the second conductive path opposite thereto may be 2.5, 2, 1.75, 1.5, 1.25, 1 or 0.5 times the first width of the wide conductive segment 380. A large gap makes it possible to shorten the end-to-end length of the dipole arm 310 and therefore contributes to the compactness of the radiating element 300.

Further, the meandered narrow conductive segment 370 may be implemented as a non-linear conductive segment, and may act as a high impedance segment that at least partially suppresses or interrupts currents within a high-band and/or a mid-band range that could otherwise be induced on the first conductive circuit loop 330. As such, the narrow conductive segment 370 may reduce induced high-band and/or mid-band currents on the low-band radiating element 300, thereby further reducing the scattering effect of the low-band radiating element 300 on the high-band and/or mid-band radiating elements. The narrow conductive segment 370 may make the first conductive circuit loop 330 almost invisible to the high-band and/or mid-band radiating elements, and thus endows the low-band radiating element 300 with a cloaking function. It is advantageous for the low-band radiating element 300 to have such a cloaking function because the less high-band and/or mid-band currents induced on the dipole arm 310 of the low-band radiating element 300, the smaller impact on the radiation pattern characteristics of the linear array of high-band and/or mid-band radiating elements.

However, due to the design of the first conductive circuit loop 330 of the dipole arm 310 of the radiating element 300, the operating frequency band of the radiating element 300 related to the first conductive circuit loop 330 may change. For example, the operating frequency band may be narrowed and/or the location of the center frequency of the operating frequency band may shift. These changes in the operating frequency band negatively affect the stable RF performance of the radiating element 300 within its set operating frequency band. In some embodiments, the set operating frequency band of the radiating element 300 may be, for example, 617-960 MHz. However, the first conductive circuit loop 330 of the radiating element 300 cannot work in the entire operating frequency band as required. For example, in some embodiments, the first conductive circuit loop 330 can only work in the sub-band 617-860 MHz, and cannot obtain good radiation performance in the sub-band 860-960 MHz. In other embodiments, the first conductive circuit loop 330 can only work in the sub-band 760-960 MHz, and cannot obtain good radiation performance in the sub-band 617-760 MHz.

In order to improve the RF performance of the radiating element 300 in a predetermined operating frequency band, a radiating arm based on a multi-resonance circuit is proposed. Continuing to refer to FIG. 3, the dipole arms 310 of the radiating elements 300 may include a plurality of conductive circuit loops. In the embodiment of FIG. 3, the dipole arms 310 may include a first conductive circuit loop 330 and a second conductive circuit loop 340. The first conductive circuit loop 330 may be configured as a first resonance circuit, which may be designed for a first sub-band in the operating frequency band of the radiating element 300. The second conductive circuit loop 340 may be configured as a second resonance circuit, which may be designed for a second sub-band in the operating frequency band of the radiating element 300. In other words, the resonance frequency of the first resonance circuit can be designed as the center frequency of the first sub-band, and the resonance frequency of the second resonance circuit can be designed as the center frequency of the second sub-band.

The resonance frequency of the first resonance circuit is smaller than the resonance frequency of the second resonance circuit. The first sub-band and the second sub-band may respectively occupy a part of the operating frequency band and together constitute the entire operating frequency band. In the embodiment of FIG. 3, the first sub-band and the second sub-band may be designed to have frequency bands which are partially overlapped or have frequency bands which are completely separated. In some embodiments, the first sub-band may be designed as a lower portion of the operating frequency band, such as 617-860 MHz, and the second sub-band may be designed as a higher portion of the operating frequency band, such as 860-960 MHz. In other embodiments, the first sub-band may be designed as a lower portion of the operating frequency band, such as 617-900 MHz, and the second sub-band may be designed as a higher portion of the operating frequency band, such as 860-960 MHz. In other embodiments, the first sub-band may be designed as a higher portion of the operating frequency band, and the second sub-band may be designed as a lower portion of the operating frequency band.

In the embodiment of FIG. 3, the second conductive circuit loop 340 may be in the first conductive circuit loop 330 and have a common conductive segment with the first conductive circuit loop 330. The common conductive segment may include at least a part of the wide conductive segment and/or at least a part of the narrow conductive segment on the first conductive circuit loop 330. In addition, the dipole arm 310 may further include an additional conductive segment 350, which may be used as a separate segment separately attached to the second conductive circuit loop 340 to bridge within the first conductive circuit loop 330. The additional conductive segment 350 may be configured to short the first conductive circuit loop 330. In some embodiments, the additional conductive segment 350 may be bridged from a first wide conductive segment to a second wide conductive segment, for example, an opposite second wide conductive segment, of the first conductive circuit loop 330, thereby being electrically connected with the common conductive segment to form the second conductive circuit loop 340. In other embodiments, the additional conductive segment 350 may also be bridged from any wide conductive segment to any narrow conductive segment of the first conductive circuit loop 330, or bridged from any narrow conductive segment to any wide or narrow conductive segment of the first conductive circuit loop 330. In order to provide the additional conductive segment 350, the supporting structure 360 of the radiating element may be provided with a bridging portion 361 bridging the first conductive circuit loop 330. The additional conductive segment 350 may have a narrower dimension, for example, may have a width equal to or less than 2 mm, 1.5 mm, 1 mm, 0.8 mm, 0.7 mm, 0.5 mm, 0.2 mm. In some embodiments, the additional conductive segment 350 may also be configured as a meandered non-linear conductive segment. The additional conductive segment 350 may act as a high impedance segment that at least partially suppresses or interrupts currents within a high-band and/or a mid-band range that could otherwise be induced on the second conductive circuit loop 340, thereby further reducing the scattering effect of the low-band radiating element 300 on the high-band and/or mid-band radiating elements.

In the embodiment of FIG. 3, since the second conductive circuit loop 340 is inside the first conductive circuit loop 330 and the path length of the second conductive circuit loop 340 is smaller than the path length of the first conductive circuit loop 330, the second conductive circuit loop 340 can be designed for a higher sub-band and the first conductive circuit loop 330 can be designed for a lower sub-band. However, in other embodiments, the second conductive circuit loop 340 may also be provided outside the first conductive circuit loop 330, for example, the additional conductive segment 350 may be provided outside the first conductive circuit loop 330. In this case, the path length of the second conductive circuit loop 340 is larger than the path length of the first conductive circuit loop 330, and thus the second conductive circuit loop 340 can be designed for a lower sub-band and the first conductive circuit loop 330 can be designed for a higher sub-band.

FIG. 4 is a schematic current distribution diagram of the radiating element of FIG. 3. By appropriately designing the first conductive circuit loop 330 and the second conductive circuit loop 340, the current distribution on the dipole arms 310 can become more balanced, thereby improving the RF performance of the radiating element. In some embodiments, currents can be shunted on the dipole arms 310 by appropriately designing the additional conductive segment 350. In other words, an appropriate amount of currents will flow through the additional conductive segment 350, thereby reducing the current amplitude on a partial area of the dipole arms 310 to make the current distribution more even.

It should be understood that the radiating element may also be provided with more conductive circuit loops, for example, forming three conductive circuit loops by providing two additional conductive segments 350, and details are not described herein again.

Next, a radiating element 300' according to some embodiments of the present disclosure will be described in more detail with reference to FIGS. 5*a* to 5*c*. It should be understood that the above descriptions relating to the radiating element 300 in FIGS. 3 and 4 can be directly applied to the radiating element 300', and only the differences from the radiating element 300 are described herein.

Figure 5A:
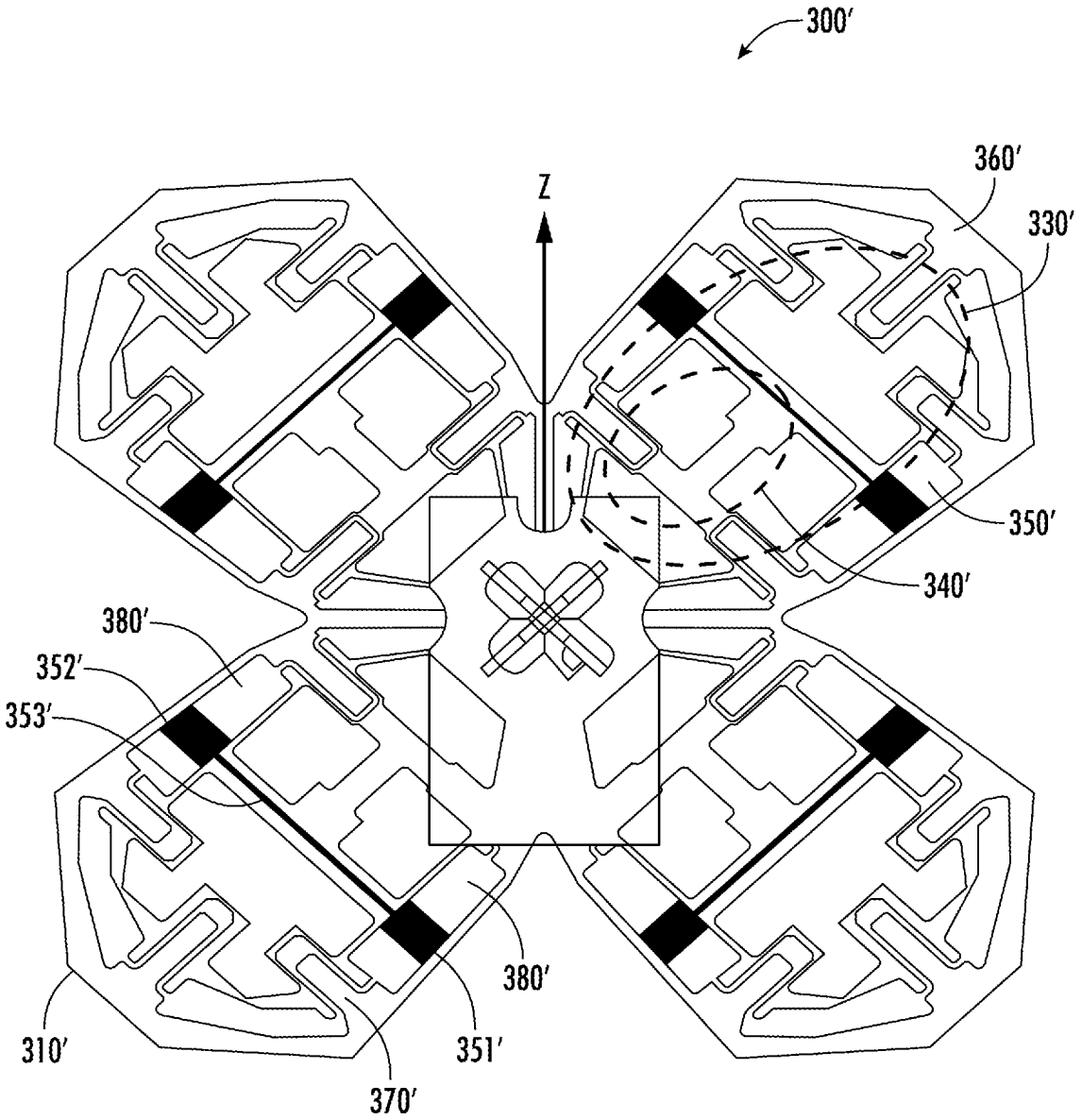
FIG. 5*a* is a schematic front view of a radiating element according to some embodiments of the present disclosure, where an additional conductive segment on a second main surface of a dielectric plate is additionally shown.

FIG. 5*a* is a schematic front view of the radiating element 300' and additionally shows an additional conductive segment 350' on a second main surface of a dielectric plate 360' (it should be understood that the additional conductive segment 350' cannot be seen in the schematic front view). As shown in FIG. 5*a*, in order to form a second conductive circuit loop 340', at least one additional conductive segment 350' may be provided on the second main surface of the dielectric plate 360' as a supporting structure. The additional conductive segment 350' may be electrically coupled (e.g., capacitively coupled) with a first conductive circuit loop 330' on the first main surface of the dielectric plate, so that the additional conductive segment 350' can be electrically coupled with the common conductive segment on the first main surface of the additional conductive segment 350' to form the second conductive circuit loop 340'.

Figure 5B:
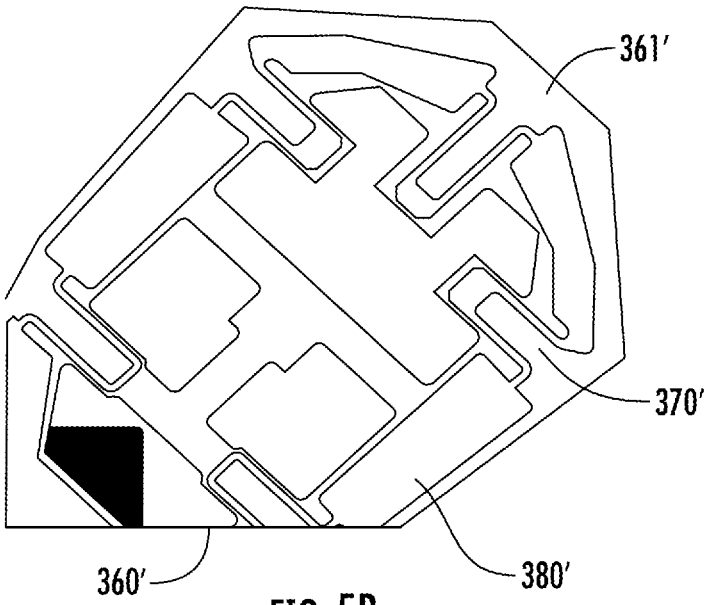
FIG. 5*b* is a schematic view of a first main surface of the dielectric plate of a dipole arm portion of the radiating element of FIG. 5*a;*

FIG. 5*b* is a schematic view of a dipole arm 310' portion of the radiating element 300' provided on a first main surface 361' of the dielectric plate 360'. The dipole arm 310' portion is configured as the first conductive circuit loop 330' including at least one narrow conductive segment 370' and at least one wide conductive segment 380'. Details are not described herein again.

Figure 5C:
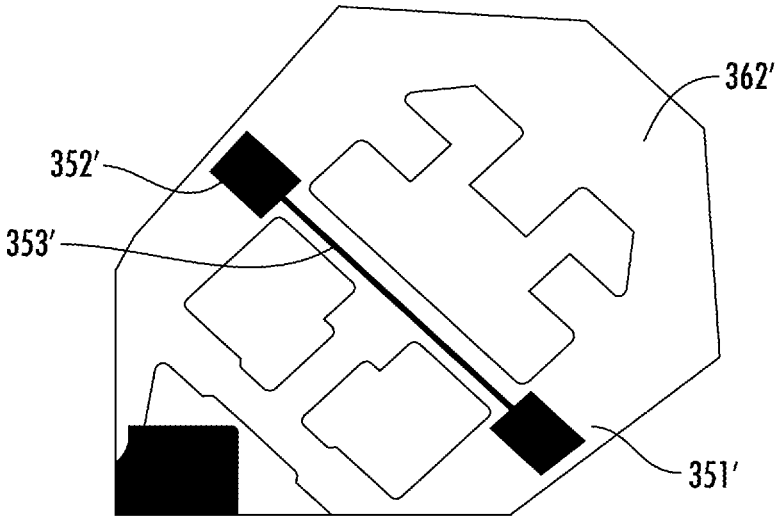
FIG. 5*c* is a schematic view of a second main surface of the dielectric plate of a dipole arm portion of the radiating element of FIG. 5*a.*

FIG. 5*c* is a schematic view of the dipole arm 310' portion of the radiating element 300' provided on a second main surface 362' of the dielectric plate 360'. The dipole arm 310' portion is configured as the additional conductive segment 350'. As shown in FIGS. 5*a* and 5*c*, the additional conductive segment 350' may include a first coupling portion 351', a first coupling portion 352', and a conductive segment 353' connected between the first coupling portion 351' and the first coupling portion 352'. The first coupling portion 351' may be electrically coupled with the first conductive circuit loop 330', and the first coupling portion 352' may be electrically coupled with the first conductive circuit loop 330'. In the current embodiment, the first coupling portion 351' may be electrically coupled with a first wide conductive segment 380' of the first conductive circuit loop 330, and the first coupling portion 352' may be electrically coupled with a second wide conductive segment 380' of the first conductive circuit loop 330', wherein the first wide conductive segment and the second wide conductive segment may be opposite to each other. In addition, the first coupling portion 351' may be configured as a first wide segment, the first coupling portion 352' may be configured as a second wide segment, and the conductive segment 353' connected between the first coupling portion 351' and the first coupling portion 352' may be configured as a narrow segment, thereby constituting a capacitance-inductance-capacitance (CLC) structure. The CLC structure is advantageous, and the current distribution on the second conductive circuit loop 340' can be changed by designing the CLC structure. In some instances, the CLC structure may act as a high impedance segment that can interrupt currents in at least one frequency band outside the operating frequency band of the radiating element that could otherwise be induced on the second conductive circuit loop 340', thereby further reducing the scattering effect of the radiating element on radiating elements in other frequency bands.

In view of the above, the present disclosure provides at least the following embodiments.

Some embodiments provide, a radiating element. The radiating element may include a dipole arm including a first conductive circuit loop and a second conductive circuit loop which is at least partially separated from the first conductive circuit loop. The first conductive circuit loop may include at least one narrow conductive segment and at least one wide conductive segment, and the narrow conductive segment may exhibit high impedance characteristics in at least one frequency band outside an operating frequency band of the radiating element to suppress at least partially currents in the at least one frequency band.

In some embodiments, the first conductive circuit loop may be configured as a first resonance circuit and the second conductive circuit loop may be configured as a second resonance circuit, and the first resonance circuit may have a resonance frequency different from that of the second resonance circuit.

In some embodiments, the resonance frequency of the first resonance circuit may be smaller than the resonance frequency of the second resonance circuit.

In some embodiments, the first conductive circuit loop and the second conductive loop have a common conductive segment.

In some embodiments, the dipole arm of the radiating element further includes an additional conductive segment, and the additional conductive segment and the common conductive segment may be electrically connected to form the second conductive circuit loop.

In some embodiments, the additional conductive segment may be configured to short the first conductive circuit loop.

In some embodiments, the additional conductive segment may be bridged from a first wide conductive segment of the first conductive circuit loop to a second wide conductive segment of the first conductive circuit loop.

In some embodiments, the dipole arm of the radiating element may be a sheet metal dipole arm, and the radiating element further may include a supporting structure. The first conductive circuit loop and the additional conductive segment may be both provided on a first main surface of the supporting structure.

In some embodiments, the supporting structure has a bridging portion, and the additional conductive segment is provided on the bridging portion.

In some embodiments, the dipole arm of the radiating element may be a printed circuit board dipole arm that comprises a metal pattern printed on a dielectric substrate, and the first conductive circuit loop and the additional conductive segment may be both printed on a first main surface of the dielectric substrate.

In some embodiments, the dipole arm of the radiating element may also include at least one additional conductive segment, and the additional conductive segment and the common conductive segment may be electrically coupled to form the second conductive circuit loop.

In some embodiments, the additional conductive segment may include a first coupling portion, a second coupling portion, and a conductive segment connected between the first coupling portion and the second coupling portion.

In some embodiments, the first coupling portion may be electrically coupled with the first wide conductive segment of the first conductive circuit loop, and the second coupling portion may be electrically coupled with the second wide conductive segment of the first conductive circuit loop.

In some embodiments, the first coupling portion may be configured as a first wide segment, the second coupling portion may be configured as a second wide segment, and the additional conductive segment may be configured as a narrow segment.

In some embodiments, the first wide conductive segment and the first coupling portion, the conductive segment connected between the first coupling portion and the second coupling portion, and the second wide conductive segment and the second coupling portion may together constitute a capacitance-inductance-capacitance structure.

In some embodiments, the dipole arm of the radiating element may be configured as a sheet metal, the radiating element may include a supporting structure, the first conductive circuit loop may be provided on a first main surface of the supporting structure, the supporting structure may have a bridging portion, and the additional conductive segment may be provided on a second main surface of the supporting structure opposite to the first main surface.

In some embodiments, the dipole arm of the radiating element may be a printed circuit board dipole arm that comprises a metal pattern printed on a dielectric substrate, the first conductive circuit loop may be printed on a first main surface of the dielectric substrate, and the additional conductive segment may be printed on a second main surface of the dielectric substrate that is opposite the first main surface.

In some embodiments, the first conductive circuit loop may include two conductive paths, the first conductive path may form a half of the first conductive circuit loop, the second conductive path may form another half of the first conductive circuit loop, and there may be a gap between the first conductive path and the second conductive path.

In some embodiments, the narrow conductive segment may be configured as a meandered non-linear conductive segment, and the non-linear conductive segment may act as a high impedance segment that may interrupt at least partially currents in at least one frequency band outside the operating frequency band of the radiating element that could otherwise be induced on the first conductive circuit loop.

In some embodiments, the additional conductive segment may be configured to be capable of at least partially interrupting currents in at least one frequency band outside the operating frequency band of the radiating element that could otherwise be induced on the second conductive circuit loop.

Some embodiments of the present disclosure provide a radiating element that may have a dipole arm that includes a first conductive circuit loop provided on a first main surface of a dielectric plate and a second conductive circuit loop having a first part provided on the first main surface of the dielectric plate and a second part provided on a second main surface of the dielectric plate.

In some embodiments, the first part of the second conductive circuit loop may be configured as a common conductive segment shared with the first conductive circuit loop.

In some embodiments, the first conductive circuit loop may be configured as a first resonance circuit and the second conductive circuit loop may be configured as a second resonance circuit. The first resonance circuit may have a resonance frequency smaller than that of the second resonance circuit.

In some embodiments, the second part of the second conductive circuit loop may include a first coupling portion, a second coupling portion, and a conductive segment connected between the first coupling portion and the second coupling portion.

In some embodiments, the first conductive circuit loop and the first coupling portion, the conductive segment connected between the first coupling portion and the second coupling portion, and the first conductive circuit loop and the second coupling portion may constitute a capacitance-inductance-capacitance structure.

In some embodiments, the dipole arm of the radiating element may be a sheet metal dipole arm, the first conductive circuit loop may be supported on a first main surface of the dielectric plate, the dielectric plate may have a bridging portion, and the second part of the second conductive circuit loop may be supported on a second main surface of the dielectric plate opposite to the first main surface so that the second part of the second conductive circuit loop may bridge over the first conductive circuit loop on the second main surface.

In some embodiments, the dipole arm of the radiating element may be configured as a printed circuit board dipole arm that comprises a metal pattern printed on a dielectric substrate, the first conductive circuit loop may be printed on the first main surface of the dielectric substrate, and the second part of the second conductive circuit loop may be printed on the second main surface of the dielectric substrate that is opposite the first main surface.

Some embodiments of the present disclosure provide a base station antenna that may include a feed board; and a radiating element mounted on the feed board. The radiating element may include a dipole arm that includes a first conductive circuit loop provided on a first main surface of a dielectric plate and a second conductive circuit loop having a first part provided on the first main surface of the dielectric plate and a second part provided on a second main surface of the dielectric plate.

Although exemplary embodiments of the present disclosure have been described, those skilled in the art should appreciate that many variations and modifications are possible in the exemplary embodiments without materially departing from the spirit and scope of the present disclosure. Therefore, all variations and modifications are included in the protection scope of the present disclosure defined by the claims.

What is claimed is:

1. A radiating element, comprising:

a dipole arm including a first conductive circuit loop comprising at least one narrow conductive segment and first and second wide conductive segments, the dipole arm further including a second conductive circuit loop which is at least partially separated from the first conductive circuit loop, wherein the first conductive circuit loop and the second conductive circuit loop share a common conductive segment, wherein the dipole arm includes an additional conductive segment, and wherein the common conductive segment and additional conductive segment are electrically connected to form the second conductive circuit loop, wherein the additional conductive segment is bridged from the first wide conductive segment of the first conductive circuit loop to the second wide conductive segment of the first conductive circuit loop, and wherein the narrow conductive segment exhibits high impedance characteristics in at least one frequency band outside an operating frequency band of the radiating element so as to at least partially suppress currents in the at least one frequency band.

2. The radiating element according to claim 1, wherein the first conductive circuit loop is configured as a first resonance circuit and the second conductive circuit loop is configured as a second resonance circuit, and wherein the first resonance circuit has a resonance frequency different from that of the second resonance circuit.

3. The radiating element according to claim 2, wherein the resonance frequency of the first resonance circuit is smaller than the resonance frequency of the second resonance circuit.

4. The radiating element according to claim 1, wherein the dipole arm of the radiating element is a sheet metal dipole arm, the radiating element further comprising:

a supporting structure, wherein the first conductive circuit loop and the additional conductive segment are both provided on a first main surface of the supporting structure.

5. The radiating element according to claim 4, wherein the supporting structure has a bridging portion, and the additional conductive segment is provided on the bridging portion.

6. The radiating element according to claim 1, wherein the dipole arm of the radiating element is a printed circuit board dipole arm that comprises a metal pattern printed on a dielectric substrate, and the first conductive circuit loop and the additional conductive segment are both printed on a first main surface of the dielectric substrate.

7. The radiating element according to claim 1, wherein the additional conductive segment includes a first coupling portion, a second coupling portion, and a conductive segment connected between the first coupling portion and the second coupling portion.

8. The radiating element according to claim 7, wherein the first coupling portion is electrically coupled with the first wide conductive segment, and the second coupling portion is electrically coupled with the second wide conductive segment.

9. The radiating element according to claim 7, wherein the first coupling portion is configured as the first wide conductive segment, the second coupling portion is configured as the second wide conductive segment, and the conductive segment connected between the first coupling portion and the second coupling portion is configured as a narrow segment.

10. The radiating element according to claim 9, wherein the first wide conductive segment and the first coupling portion, the conductive segment connected between the first coupling portion and the second coupling portion, and the second wide conductive segment and the second coupling portion together constitute a capacitance-inductance-capacitance structure.

11. The radiating element according to claim 1, wherein the first conductive circuit loop includes first and second conductive paths, wherein the first conductive path forms a half of the first conductive circuit loop, wherein the second conductive path forms another half of the first conductive circuit loop, and wherein there is a gap between the first conductive path and the second conductive path.

12. The radiating element according to claim 1, wherein the at least one narrow conductive segment is configured as a meandered non-linear conductive segment, and the non-linear conductive segment acts as a high impedance segment that at least partially interrupts currents in at least one frequency band outside the operating frequency band of the radiating element that could otherwise be induced on the first conductive circuit loop.

13. The radiating element according to claim 1, wherein the additional conductive segment is configured to be capable of at least partially interrupting currents in at least one frequency band outside the operating frequency band of the radiating element that could otherwise be induced on the second conductive circuit loop.

14. The radiating element according to claim 1, wherein the additional conductive segment is configured to short the first conductive circuit loop.

15. A radiating element, comprising:

a dipole arm including a first conductive circuit loop having a first conductive path and a second conductive path, each of the first and second conductive paths comprising a respective narrow conductive segment and a respective wide conductive segment, the conductive segments of the first and second conductive paths spaced apart from each other by a gap, the dipole arm further including a second conductive circuit loop which is partially separated from the first conductive circuit loop and which includes an additional conductive segment connected across the gap to a conductive segment of the first conductive path and to a conductive segment of the second conductive path, wherein each narrow conductive segment exhibits high impedance characteristics in at least one frequency band outside an operating frequency band of the radiating element so as to at least partially suppress currents in the at least one frequency band.

16. The radiating element according to claim 15, wherein the dipole arm of the radiating element is a sheet metal dipole arm, the radiating element further comprising:

a supporting structure, wherein the first conductive circuit loop and the additional conductive segment are both provided on a first main surface of the supporting structure.

17. The radiating element according to claim 15, wherein the dipole arm of the radiating element is a printed circuit board dipole arm that comprises a metal pattern printed on a dielectric substrate, and the first conductive circuit loop and the additional conductive segment are both printed on a first main surface of the dielectric substrate.

18. A radiating element, comprising:

a dipole arm including a first conductive circuit loop comprising at least one narrow conductive segment and first and second wide conductive segments, the dipole arm further comprising a second conductive circuit loop which is partially separated from the first conductive circuit loop, wherein the first conductive circuit loop and the second conductive circuit loop share a common conductive segment, wherein the dipole arm comprises an additional conductive segment, and wherein the common conductive segment and the additional conductive segment are electrically connected to form the second conductive circuit loop, wherein the additional conductive segment includes a first coupling portion, a second coupling portion, and a conductive segment connected between the first coupling portion and the second coupling portion, wherein the first coupling portion is electrically coupled with the first wide conductive segment, and the second coupling portion is electrically coupled with the second wide conductive segment, and wherein the narrow conductive segment of the first conductive circuit loop exhibits high impedance characteristics in at least one frequency band outside an operating frequency band of the radiating element so as to at least partially suppress currents in the at least one frequency band.

19. The radiating element according to claim 18, wherein the dipole arm of the radiating element is a sheet metal dipole arm, the radiating element further comprising:

a supporting structure, wherein the first conductive circuit loop and the additional conductive segment are both provided on a first main surface of the supporting structure.

20. The radiating element according to claim 18, wherein the dipole arm of the radiating element is a printed circuit board dipole arm that comprises a metal pattern printed on a dielectric substrate, and the first conductive circuit loop and the additional conductive segment are both printed on a first main surface of the dielectric substrate.

* * * * *